United States Patent [19]

Creps

[11] 4,358,887

[45] Nov. 16, 1982

[54] METHOD FOR GALVANIZING AND PLASTIC COATING STEEL

[76] Inventor: John A. Creps, 251 Dartmouth Ave., Canfield, Ohio 44406

[21] Appl. No.: 137,546

[22] Filed: Apr. 4, 1980

[51] Int. Cl.[3] ..... B22D 11/126; B21B 45/00; B21C 23/24

[52] U.S. Cl. ..... 29/527.4; 29/33 Q; 72/372; 72/46; 72/47

[58] Field of Search ..... 29/527.2, 527.1, 33 Q, 29/527.4; 72/47, 46, 228, 371, 372, 399

[56] References Cited

U.S. PATENT DOCUMENTS

| | | | |
|---|---|---|---|
| 2,588,439 | 3/1952 | Ward | 72/47 |
| 3,082,119 | 3/1963 | Harris | 117/114 |
| 3,123,493 | 3/1954 | Brick | 117/50 |
| 3,338,208 | 8/1967 | Voss | 118/38 |
| 3,343,930 | 9/1967 | Borzillo et al. | 29/196.2 |
| 3,393,089 | 7/1968 | Borzillo et al. | 117/114 |
| 3,524,245 | 8/1970 | Searing | 29/430 |
| 3,536,036 | 10/1970 | Matsudo | 118/67 |
| 3,559,280 | 2/1971 | Mailhiot et al. | 29/527.4 |
| 3,782,909 | 1/1974 | Cleary et al. | 29/196.2 |
| 3,845,540 | 11/1974 | Rossi et al. | 29/430 |
| 3,860,438 | 1/1975 | Shoemaker | 117/50 |
| 3,927,816 | 12/1975 | Nakamura | 228/147 |
| 4,124,932 | 11/1978 | Rogove et al. | 29/527 |
| 4,155,235 | 5/1979 | Pierson et al. | 72/47 |

FOREIGN PATENT DOCUMENTS

| | | | |
|---|---|---|---|
| 743047 | 9/1966 | Canada | 117/113 |

OTHER PUBLICATIONS

Iron & Steel Engineer (Jul. 1976), p. 31.
Metal Finishing Magazine (Sep. 1978).
International Metal Review, Review 237 (1979), p. 1.

*Primary Examiner*—Charlie T. Moon
*Assistant Examiner*—V. K. Rising
*Attorney, Agent, or Firm*—Fay & Sharpe

[57] ABSTRACT

A method and apparatus for galvanized pipe and other formed sections which sometimes include reentrant angles and strapping. The pipe and other sections are sized and hot dipped in a bath of molten zinc at a temperature of about 850° F. (450° C.) and then controlled for thickness with an air knife. The molten zinc is cooled at a rate of 20°–70°/second by an air blast or an air amplifier to solidify the zinc coating before the formation of more than 0.00008" to 0.00018" of intermetallic compound to form a layer of zinc from 0.0004" to 0.0008" in thickness. The zinc is water quenched without the formation of spangles and plastic coated with a layer of polyesters, vinyl alkyds or fluorocarbons, from 0.002" to 0.006", resulting in a coated steel that does not develop extensive rust corrosion in less than 1000 hours in a neutral salt spray. The formed product meets ASTM A-525 specifications and is designated G-30 or G-60 according to the thickness of the zinc layer.

13 Claims, 7 Drawing Figures

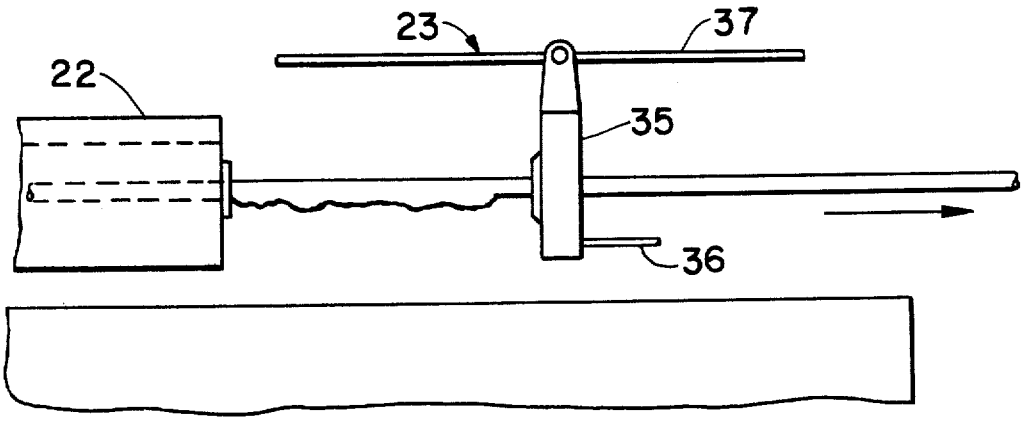
FIG. 2
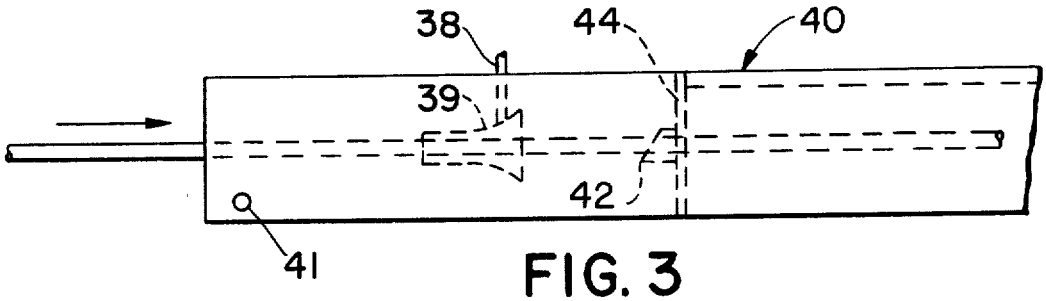
FIG. 3
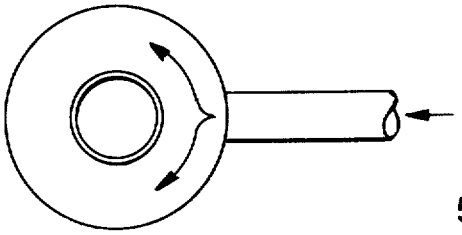
FIG. 4
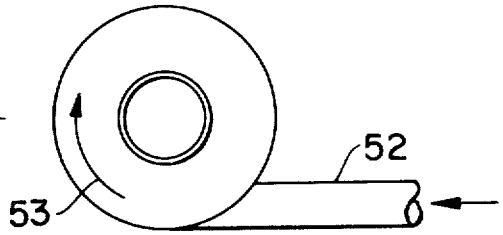
FIG. 5
FIG. 6
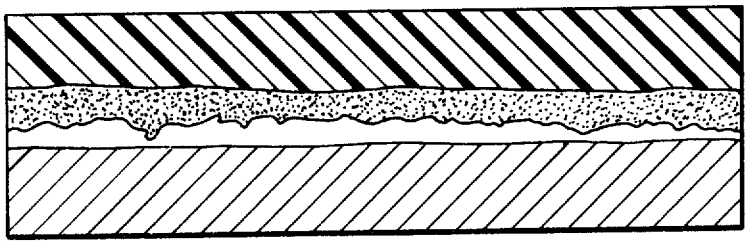
FIG. 7
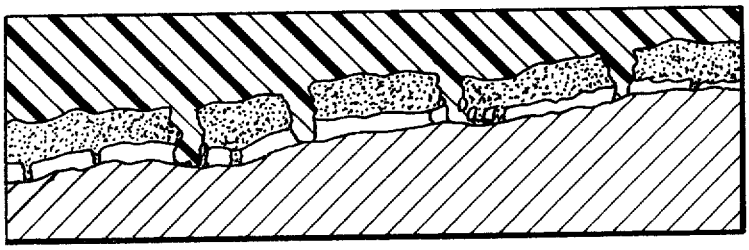

METHOD FOR GALVANIZING AND PLASTIC COATING STEEL

BACKGROUND OF THE INVENTION

Zinc coated steels are known to be very old in the art and have been widely used. Large portions of such steels are made by hot dipping in a molten zinc bath at a temperature of 850° F. (450° C.). The zinc acts as a barrier between the substrate of steel and the atmosphere. Zinc acts as the galvanic protector sacrificing itself in the presence of corrosive elements. A plastic coating further protects the zinc.

A. J. Raymond in IRON & STEEL ENGINEER, p. 31, July 1976, describes the current manner in which steel is taken off a coil reel, is attached with a strip joiner (a welding device), is passed through a looper, a strip washer and a pinch roll unit, and then is moved to the tube forming and welding unit; for example, a Yoder mill. The steel is then cleaned and pickled, preheated to temperature, galvanized water quenched, sized and cut off. The process produces electrical conduit, EMT and I.M.C., fence tubing and galvanized mechanical tubing. Additionally, other techniques are known to exist from the following U.S. patents:

Mailhiot et al U.S. Pat. No. 3,559,280
Searing U.S. Pat. No. 3,524,245
Pierson et al. U.S. Pat. No. 4,155,235
Harris U.S. Pat. No. 3,082,119
Brick U.S. Pat. No. 3,123,493
Voss U.S. Pat. No. 3,338,208
Rogove et al. U.S. Pat. No. 4,124,932
Shoemaker U.S. Pat. No. 3,860,438
Matsudo et al. U.S. Pat. No. 3,536,036
Cleary et al. U.S. Pat. No. 3,782,909
Nakamura U.S. Pat. No. 3,927,816
Rossi et al. U.S. Pat. No. 3,845,540
Borzillo et al. U.S. Pat. No. 3,343,930
Borzillo et al. U.S. Pat. No. 3,393,089

In current practice it is possible to obtain good rust resistant coatings on sheet and tubing; however, zinc reacts with steel to form intermetallic compounds that grow rapidly in thickness at temperatures above the melting point of zinc, and the layers formed become intensely brittle. It is essential to keep such layers as thin as possible, which is precisely what the present invention intends to facilitate.

Current practice also provides for sizing after galvanizing. Many galvanized products are galvanized after manufacture is complete due to the brittle layer that has formed. However, this present process insures that the protective layer of zinc formed over the zinc/steel alloy during hot-dip galvanizing remains unbroken and undamaged by the manufacturing process.

Spangles formed on zinc create still another problem, but the present process produces a bright shiny finish that is spangle free. It is known, of course, that Canadian Pat. No. 743,047 does make an attempt to produce a spangle-free, hot-dip galvanized product and one that has a bright and shiny lustrous appearance. However, that patent works on the idea of retarding or slowing down the cooling rate of the strip by holding the strip upon emergence from the coating bath at a temperature slightly above the melting point of the coating and for a predetermined time and temperature. In the present process, the product is held at about 750° F.–850° F. for a period of only 5 to 30 seconds, after which the coating is allowed to solidify in the conventional manner.

METAL FINISHING magazine of September 1978 discusses other teachings which provide for hot-dip aluminum zinc alloy coatings requiring that they be hot dipped for 10 seconds in the bath, removed slowly and cooled in a blast of air. For example, Searing U.S. Pat. No. 3,524,245, cited above, teaches a sprayed zinc process, while Pierson et al. U.S. Pat. No. 4,155,235, cited above, employs a vertical air quench to solidify the aluminum coating on the tube before water quenching.

It has not been known previously to produce spangle-free galvanizing in a combination of air quenching and water quenching to preserve the brightness of the zinc coating. Rogove U.S. Pat. No. 4,124,932, cited above, refers to a pre-quenching cooling step for galvanizing tube, whereby the tubing is cooled from a flow of water and results in the surface of the zinc coating being superficially set. The tubing afterwards enters a liquid cooling bath where solidification of the zinc coating is completed.

Borzillo et al. U.S. Pat. No. 3,393,089 teach the idea of air quenching galvanized zinc, while Borzillo et al. U.S. Pat. No. 3,343,930 and Cleary et al. U.S. Pat. No. 3,782,909 teach processes for aluminum zinc coatings (all cited above). In general, however, the brittle intermetallic compound has created problems in the prior art. Cleary et al. U.S. Pat. No. 3,782,909 teach the idea of passing the coated strip through gas wiping dies (16) and of an accelerated cooling chamber (19); however, the strip is not water quenched or plastic coated. Shoemaker U.S. Pat. No. 3,860,438 is another air cooling patent as is Searing U.S. Pat. No. 3,524,245 where a Ransburg type of zinc coating is provided, and the tube is sized before coating. The metallurgy of zinc coating is covered in detail in INTERNATIONAL METAL REVIEW, Review 237, p. 1, J. Mackowiak, N. R. Short, "Metallurgy of Galvanized Coatings" (1979).

One particularly dramatic weakness of the prior art is that the sizing to final tolerance is usually accomplished after galvanizing, resulting in rupture of the bonding of the zinc to the steel. In the process of this invention the sizing is accomplished before galvanizing.

SUMMARY OF THE INVENTION

The principal concepts of the present invention reside in the steps of forming, galvanizing and all subsequent continuous steps for fabrication of the final tubing.

Either cold rolled oiled strip or hot rolled pickled and oiled strip of the required size is fed off a suitable payoff reel through an end detector into a loop accumulator system and into a caustic scrubber to remove all oil and any dirt that may have been present on the wraps of the coiled strip, whether cold rolled or hot rolled. In order to clean the strip surfaces rapidly and completely, the caustic scrubbing solution is heated to an appropriate temperature below boiling. After scrubbing, the strip is next rinsed in water and then passed through an air knife, a series of high-pressure air nozzles that blow off the water present on both surfaces of the strip.

The next step is to pass the strip through the tube forming mill at the end of which the adjacent surfaces or edges, now that the strip is formed into a tube, are electrically welded together, and any excess metal on the outside of the tube mechanically removed from the weld. Then, the tube goes into the final sizing mill to true up its shape prior to coating, an important feature of this invention. Immediately after the sizing mill, it is necessary to remove all oil or grease picked up in tube forming and sizing mills by another caustic bath.

Following this cleaning, the tube is run through a hydrochloric acid pickling and cleaning solution to prepare it for the subsequent galvanizing operation. Immediately following the two mentioned cleaning operations, the tubing enters a heating unit operated with electricity which by induction heats the tube walls to near but below the melting point of zinc, approximately 700° F. While being heated, the tube is surrounded by an inert non-oxidizing gas to prevent any oxidation or scaling of the clean tube surface. This inert atmosphere takes the place of and serves as a flux for the subsequent galvanizing operation. The tube enters the galvanizing manifold immediately beyond the inert atmosphere heater where it is surrounded with molten zinc, 830° F.–850° F., which wets and alloys with the steel surface.

Upon leaving the zinc manifold, the continuous length of tubing loses much of the adhering molten zinc by the zinc dripping off at preset distance to control the thickness of the zinc coating in a positive manner, and the remaining excess zinc is blown off by a fully adjustable, circular high-pressure air nozzle or air knife.

After passing beyond the air knife, the galvanized tube cools in air for a distance usually between nine and twelve feet before it enters the water quench trough. The water cools the tubing to ambient temperature. At this point a small amount of chromate compound is deposited on the shiny galvanized coating to retain its brightness.

The final treatment to the tube is to apply clear plastic coating in conjunction with a fluidized bed using air pressure and an electrostatic field on the order of 60,000–80,000 volts. Leaving the fluidized bed, the tubing is again heated by an electric induction heater to melt the plastic particles adhering to the tube and thus forms a continuous clear plastic coating over the entire outer surface. The heating also cures the plastic which is of a thermosetting or thermoplastic type. Upon leaving the induction heater, the tube is again water cooled for the final time.

Now the tube goes through a series of pullout rolls and turkshead rolls for straightening. After cutting to length, the tube is sprayed on its inside with a paint, a zinc-rich paint if so desired. Once the cut lengths of tubing have the paint on the inside set and have gone through inspection, they are ready for the market.

The steps previously described while only specifically mentioning tubing are equally applicable to steel strip of suitable dimensions or continuous shapes, such as tees or angles.

BRIEF DESCRIPTION OF THE DRAWINGS

Details of the preferred embodiment of this invention are described in detail in this specification and are illustrated in the accompanying drawings which form a part hereof, wherein:

FIG. 2 is a schematic diagram of the galvanized apparatus and the air knife;

FIG. 3 is a diagram of the air blast cooling section and the water quenching operation;

FIG. 4 is a diagram of the air blast for controlling the galvanizing deposit;

FIG. 5 is an alternate modification of the air blast;

FIG. 6 is a photomicrograph of the zinc coating on surface of tubing. Coating thickness is 0.0004"–0.0006" thick and alloy layer is 0.00015" thick; magnification 500 diameters; transverse section with a nital etch; and FIG. 7 is a photomicrograph of the galvanized coating at the apex of the bend of a flattened tubing. Though coating is ruptured on a microscopic scale, adherence remains excellent and protective power is not impaired. Coating thickness is 0.0004"–0.0008" thick and alloy layer is 0.00012" thick. Weight of coating is 0.4 ounces per square foot; magnification 500 diameters; transverse section with a nital etch.

DESCRIPTION OF THE PREFERRED EMBODIMENT

Figure 1:
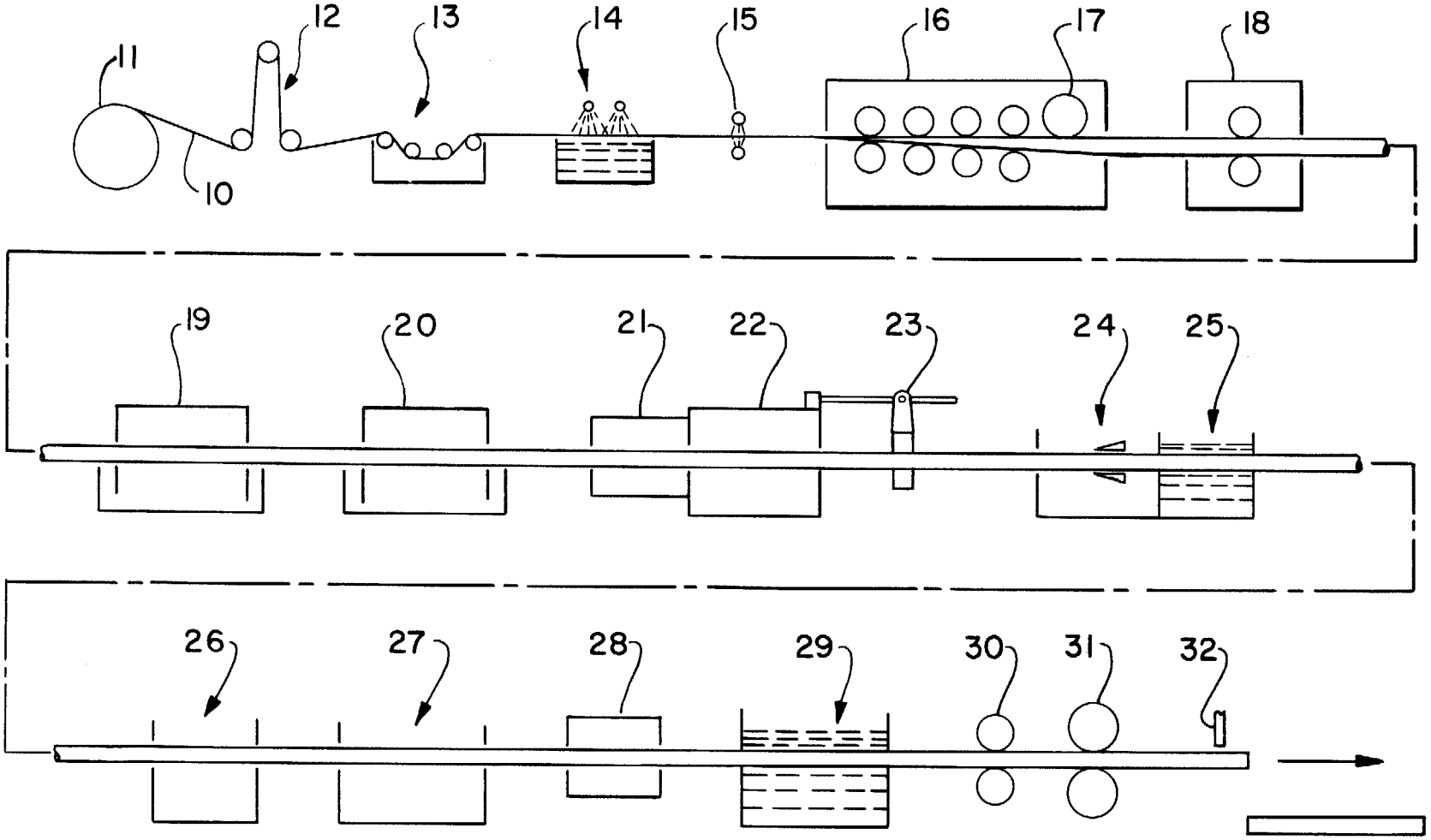
FIG. 1 is a schematic diagram of the method and apparatus of the invention.

The present invention relates to a method and apparatus for galvanizing and plastic coating tubing and other reentrant sections but also may include flattened sections where appropriate. The tubing and reentrant sections for purposes of this invention are generally classified as EMT, fence tubing and builders hardware products.

In the schematic diagram of FIG. 1 cold rolled steel 10 is taken off a payoff reel 11, which steel is oiled strip or hot rolled pickled and oiled strip of the required size, and is passed through a loop accumulator and joiner diagrammatically shown at 12. Continuous processing is possible by welding and joining the ends of the reel and looping through an accumulator.

Next the strip is passed through a caustic scrubber 13 to remove all oil and any dirt that has been deposited on the steel. The caustic scrubbing solution is heated to an appropriate temperature which is below boiling and after scrubbing with brushes, the strip is rinsed in water as at 14 and passed through an air knife 15 or a series of high-pressure air nozzles to blow off the water that is present on both surfaces of the strip.

The strip passes through a tube forming mill 16 in which the adjacent surfaces or edges of the strip are formed into tubing and are electrically welded as shown in the seam welder 17. Of course, it is to be understood in connection with this invention that the tube mill is able to form reentrant sections of any type without welding of the strip. It may, for example, be desirable to produce strip, such as strapping, by the same process. When a tube or reentrant section is formed, it is generally sized as at 18 because it is possible to be a few thousands of an inch off the correct dimension of the product, the dimension being determined by quality control. EMT and I.M.C. tubing are produced in ½", ¾", 1", 1½", 2", 2½" and 3". Fence tubing is produced in 1.315", 1.660", 1.990", and 2.375" sizes. In the sizing roll there are a series of stands which swage the tubing about 5 percent at a time, thus bringing the tubing down to its finished dimension and the correct size required for the specific product. The process of this invention obviates the need for sizing after galvanizing which normally causes the galvanized coating to become separated with macroscopic cracks and ruptures appearing thereon.

The tubing is once again cleaned in a caustic bath 19 and any additional oil that was deposited by the forming and sizing rolls is removed. Following this step, the tubing is pickled again in a hydrochloric acid pickling or cleaning solution 20 and rinsed to prepare it in absolutely clean form for the galvanizing operation which is subsequent thereto.

The tube enters a heating unit 21 using induction heating and 3000 Hz where it is heated to approximately 700° F. While being heated, the tube is surrounded by an inert gas but preferably a reducing gas of exothermic nature formed by burning natural gas with a limited controlled quantity of air.

In connection with FIG. 2, the reducing gas serves as a flux for the subsequent galvanizing operation shown at 22. In this diagram the tube enters the galvanizing manifold and is immediately surrounded by molten zinc which wets and alloys with the steel surface. The tube passes through the mill at various speeds, from 50–400 ft./minute. The temperatures of the caustic solutions and pickle liquors are adjustable to operate under optimum conditions for the speed used.

On leaving the zinc manifold the continuous length of tubing passes through an adjustable air knife 35, which is positioned some feet away from the galvanizing tank. The air for the air knife which is impinged against the tubing is regulated to control the thickness of zinc on the tubing. The compressed air inlet is generally shown at 36 while the adjustment is generally shown at 37. The entire air knife assembly is indicated at 23.

Next, as will be noted in connection with the diagram of FIG. 3, the galvanized tubing passes through an air blast 24. One particular form of this is referred to as an air amplifier and in this case is manufactured by Vortex. Compressed air indicated at 38 is passed to the air amplifier or air blast itself as at 39. These same units may be used in series to provide cooling of the tubing in a temperature range from 20° F.–70° F./second.

In the process of this invention, then, the galvanizing, which takes pace at about 850° F., i.e. in the range 830° F.–860° F., is cooled down to about 730° F. in a short interval of time. Cooling 25 takes place in an entire distance of twelve feet before it enters the water-quenched tank indicated at 40. A water drain is shown at 41 while the water spill is shown diagrammatically at 42. A water baffle is shown at 44. The water cools the tubing to ambient temperature and air cooling results in the galvanized tubing being substantially spangle free.

The next step 26 in this process is to deposit a chromate compound on the shiny galvanized coating to retain its brightness. In the final treatment, a clear plastic coating is applied from the group consisting of polyester resins, vinyl alkyds and fluorocarbons, generally from 0.002"to 0.006". The clear plastic coating is applied in a device known as an electrostatic applicator 27 manufactured by The Electrostatic Equipment Company of New Haven, Connecticut, wherein there is an electrostatic field on the order of 60,000–80,000 volts, and one terminal is grounded and the other terminal is to the electrostatic fluidized bed. The plastic coating is attracted and electrostatically deposited on the tubing in the thickness desired.

Leaving the fluidized bed, the tube is again heated by an electric induction heater using 3000 Hz, as shown in FIG. 1 at 28, to melt the plastic particles adhering to the tube, and thus a continuous clear plastic coating is formed over the entire outer surface of the pipe. Heating cures the plastic, which is of the thermosetting or thermoplastic type. This same process can be accomplished with reentrant sections and strip.

The tube, upon leaving the induction heater, is again water cooled for the final time as shown at 29 in connection with FIG. 1, and the tube then goes through the pullout rolls 30 and to the turkshead rolls 31 for straightening. Cutting of the tubing lengths is shown at 32 in this schematic diagram. Tubing is frequently packaged in hexagonal shaped bundles and cut into many lengths, such as from 8 feet to 20 feet or more in length.

Not shown herein is the subsequent processing step of spraying the inside of the tubing with a zinc-rich paint to provide corrosion resistance to the inside of the pipe.

FIG. 4 is a diagram of the air blast in which air flows around all sides of the tube to insure a minimum uniform zinc coating. Air pressure used is about 80 psi.

The alternate modification of the air blast is shown in connection with FIG. 5, where the compressed air inlet and air is shown at 52. In this diagram air is moved in a vortex shown by the arrow indicated 53 to produce maximum cooling and flow the zinc around the tubing to produce a maximum zinc deposit. In terms of this invention, thickness of the coating varies from 0.0004" to 0.0008", but it is anticipated that greater thicknesses of zinc may be also obtained by the process of this invention.

By the process of this invention it is possible to keep the intermetallic compound formation as low as 0.00008" to 0.00018" with a total thickness typically in the range 0.0004" to 0.0008". The plastic coating then applied of the thermosetting or thermoplastic type is from 0.002" to 0.006" in thickness. The product meets the ASTM A-525 specification and is designated G-30 or G-60 in accordance with the thickness of the zinc layer.

FIGS. 6 and 7 are photomicrographs of the zinc and galvanized coatings and represent examples of the processes of this invention with their legends.

Various tests have been conducted to test the product produced in accordance with the invention. Three particular samples were selected for testing purposes and, as well, a competitive sample of tubing here designated as Sample #4.

Description of samples follows:

#1 One-piece galvanized tubing 1 15/16" (1.938") diameter 22" long with a wall thickness of 0.052".

#2 One-piece galvanized tubing 1 31/32" (1.969") diameter 24" long with a wall thickness of 0.062".

#3 One-piece galvanized tubing 1 5/8" (1.625") diameter 21" long with a wall thickness of 0.0625".

#4 Short piece of galvanized tubing 1 5/6" (1.625") diameter 3" long with a wall thickness of 0.066".

Sample #4 was produced by a competitive process which included straightening after galvanizing. This piece of tubing unlike the present invention's tubings had no plastic overcoat and instead of having the smooth, bright non-spangled appearance of this material had a mottled gray and black finish.

Zinc coating weights and thicknesses, alloy layer thicknesses, percents of iron and aluminum in the coatings and thicknesses of the polyester plastic coating were determined on all four described samples insofar as possible. Also, a part of each sample was flattened to an inside gap of 0.125" in a press to evaluate the adherence of the respective coatings. This flattening of the tubing resulted in an inside radius of essentially the thickness of the strip at the bend.

Finally, six samples of the tubing, two each from tubes #1 through #3, were submitted to a neutral salt spray test made in accordance with ASTM standard B-117-76. The salt spray has 5 percent plus or minus 1 percent sodium chloride at 92° F.–97° F. and pH 6.5–7.2. One portion of each tubing was in the salt spray test chamber for 1008 hours, at which time considerable white corrosion product developed from the attack on the zinc coating, but only very superficial rusting of the steel base. The other portion of each sample was tested for only 168 hours at which time all three pieces of tubing were removed for examination. Additional details on the results of these tests are given below.

Results of the other tests are detailed in Table 1 which follows for all four samples. It was not possible to make salt spray tests on sample #4 because of insufficient material. Standard chemical procedures were used to make all these determinations. The thickness of the plastic coatings was determined by dissolving the coating in acetone after first measuring the tubing wall thickness to the nearest 0.0001" and then remeasuring the wall thickness similarly. There was no plastic coating on the inside surface of the tubings. The total thickness of the hot dipped galvanized coatings and the related zinc-iron alloy layer was measured on prepared sections in four to five places on each tubing sample. The averages of these readings are given in Table 1. The coating thickness commonly varied over a range of 0.00075" to 0.00134" for the several samples. Similarly, the alloy layer thickness varied over ranges of 0.00008" to 0.00018". Note that the coating weights determined chemically do not parallel the coating thickness reported, presumably because of variation in coating thickness on different surface areas of the tubing.

The thickness of the outside plastic coating is essentially in the range of 2 to 3 mils (0.002" to 0.003") for the first three tubing samples, but may be as high as 6 mils. The fourth sample as previously noted had no plastic coating.

Sections of all tubing samples in the "as received" condition were mounted in bakelite and processed for microscopic examination. Also, a portion of each flattened piece of tubing cut at the sharpest bent portion was similarly prepared for microscopic examination.

The tubing coated by the process of this invention showed excellent adherence at the sharp bends at all times even though there were microscopic cracks in the coating. None of these cracks were wider than 0.0001", and they would not significantly impair the corrosion protection afforded the steel base by the coating by electrolytic action.

Photomicrographs were obtained of the several test coatings. In a photomicrograph of the coating of this invention (FIG. 6), the actual thickness varied between 0.0004" and 0.0009". This thickness is such that brittleness on deforming by bending would be kept to a minimum. This is clearly shown in another photomicrograph taken of the coating at the apex of the bend on the flattened tubing (FIG. 7). Though not shown in the photomicrograph, the plastic coating is known to have fractured at the bend. However, the zinc coating continued to adhere firmly to the steel base as shown in the second photomicrograph.

Other photomicrographs were of the corresponding sections of the competitive galvanized tubing. The coating on this latter sample was appreciably thicker with a measured thickness of 0.0008" to 0.0011", even though the chemically determined average weight of coating is only 0.35 ounces per square foot. When this competitive tubing was flattened, the coating fractured badly and failed to adhere to the steel base as shown in the fourth photomicrograph. The thickness of the alloy layer in the coating on sample #4 is some 75 percent thicker than for the coating of this invention, consistent with the greater overall coating thickness.

The plastic coating of this invention's tubings, which was free of porosity as far as could be determined, greatly increased the corrosion protection afforded by the coating. A 0.4 ounces per square foot coating, such as on these tubings, normally has a protective life from 70 hours to 230 hours in a neutral salt spray test before extensive failure occurs. The coatings of this invention were subjected to 1008 hours' exposure without any real failure producing extensive rusting of the steel base. Significantly, none of the three tubings of this invention showed any appreciable white corrosion product (frequently referred to as white rust) up to 168 hours' exposure.

It was thus concluded that the coating of this invention had excellent adherence when bent greater than would be expected from such a hot dipped coating and also gave unusually good protection against corrosion when tested in a neutral salt spray cabinet.

TABLE 1

| Sample No. | Tube Diameter Inches | Coating Weight oz/ft$^2$ | Coating Thickness Inches | Alloy Thickness Inches | Iron Al. Contents Percent | Plastic Coating Thickness Inches |
|---|---|---|---|---|---|---|
| | | | Coating Data | | | |
| 1 | 1.938 | 0.47 | .00134 | .00018 | 1.32 .03 | .0029 |
| 2 | 1.969 | 0.44 | .00075 | .00009 | 1.02 .07 | .0033 |
| 3 | 1.625 | 0.36 | .00076 | .00008 | 1.02 .001 | .0022 |
| | | | Competitive Tubing | | | |
| 4 | 1.625 | 0.35 | .00111 | .00025 | NES NES | None |

NES - Not sufficient sample for determination

TABLE 2

| | After 168 hours' exposure | | After 1008 hours' exposure | |
|---|---|---|---|---|
| Sample No. | Rust Present | White Corrosion Product | Rust Present | White Corrosion Product |
| 1 | 7 pp* | None | 2 pp* | 50% of area |
| 2 | 11 pp | None | 2 pp | 80% of surface |
| 3 | 4 pp | None | 4 pp | 90% of surface |

*pinpoint areas of red rust

There was not enough of sample #4 available to run any salt spray tests.

What is claimed is:

1. A method of galvanizing and plastic coating pipe and tubular sections, which comprises the following steps in sequence:

(a) feeding a coil of cold rolled or hot rolled ferrous metal strip to a forming mill;

(b) looping and welding the ends of the coil to produce an endless strip;

(c) cleaning the strip to remove contaminants;

(d) forming a tube section in a forming mill and seam welding said section;

(e) sizing the section to finished dimension;

(f) cleaning the strip to remove contaminants;

(g) heating said pipe sections to galvanizing temperature;

(h) galvanizing the sections with molten zinc at about 850° F.;

(i) controlling the zinc thickness with an air knife under variable pressure;

(j) accelerated cooling the molten zinc to solidify it with air blasts at a rate of 20° F.–80° F./second so that the molten zinc is held in the range of about 750° F.–850° F. for a period of 5–30 seconds between the steps of galvanizing and water quenching and so that the zinc alloy layer after said step of quenching is 0.0018" or less in thickness to prevent the formation of spangles;

(k) water quenching the sections to solidify the zinc completely;

(l) plastic coating the pipe; and (m) pulling said formed sections through the foregoing processes.

2. The method of claim 1 in which the air pressure in the air knife is adjustable between 5–15 psi to control the thickness of the zinc layer.

3. The method of claim 1 in which the zinc coating is from 0.0004" to 0.0008" in thickness.

4. The method of claim 1 in which the air cooling and water quenching steps reduce the thickness of the alloy layer to the range 0.00008" to 0.00018" in thickness.

5. The method of claim 1 in which the zinc coating is approximately 0.4 ounces per square foot.

6. The method of claim 1 in which the plastic coating is 0.002" to 0.006" in thickness.

7. The method of claim 1 in which the air knife, air cooling and water quenching steps form a bright uniform coating of zinc, free of spangles or dulling.

8. The method of claim 1 in which the zinc layer after water quenching is coated with a chromate coating before covering it with a plastic coating to improve and protect the zinc layer.

9. The method of claim 1 in which the combination of zinc and plastic produces a section that does not develop extensive rust corrosion in less than 1000 hours in a neutral salt spray which is 5 percent plus or minus 1 percent sodium chloride at 92° F.–97° F. and pH 6.5–7.2 according to ASTM standard B-117-76.

10. The method of claim 1 in which the air blast cooling is done with an air amplifier to solidify the zinc layer quickly before it reacts with the steel to produce a thick, brittle intermetallic layer.

11. The method of claim 1, wherein said step of air cooling is conducted sufficiently to reduce the zinc coating temperature to about 730° F. prior to said step of water quenching.

12. The method of claim 11, wherein said step of air cooling surrounds the galvanized pipe in a peripheral flow of pressurized air.

13. The method of claim 11, wherein said step of air cooling surrounds the galvanized pipe in a vortex flow of pressurized air.

* * * * *